United States Patent [19]

Koehler

[11] 4,316,167

[45] Feb. 16, 1982

[54] ELECTROMAGNET WITH A MOVING SYSTEM AND PERMANENT MAGNET, ESPECIALLY FOR CONTACTORS

[75] Inventor: Gérard N. Koehler, Ville D'Avray, France

[73] Assignee: La Telemecanique Electrique, Nanterre, France

[21] Appl. No.: 190,509

[22] Filed: Sep. 25, 1980

[30] Foreign Application Priority Data

Sep. 28, 1979 [FR] France ..... 79 24147

[51] Int. Cl.[3] ..... H01F 7/08

[52] U.S. Cl. ..... 335/229; 335/234

[58] Field of Search ..... 335/79, 80, 81, 179, 335/229, 230, 234, 256, 235

[56] References Cited

U.S. PATENT DOCUMENTS

| | | | |
|---|---|---|---|
| 2,633,488 | 3/1953 | Brion et al. | 335/235 |
| 2,895,090 | 7/1959 | Short | 335/256 |
| 3,504,315 | 3/1970 | Stanwell | 335/234 |
| 3,728,654 | 4/1973 | Tada | 335/234 |
| 4,142,166 | 2/1979 | Arnoux | 335/230 X |

*Primary Examiner*—George Harris

*Attorney, Agent, or Firm*—Davis, Hoxie, Faithfull & Hapgood

[57] ABSTRACT

A moving system constituted by a permanent magnet and pole-pieces is accurately guided in axial translational motion within the coil unit of an electromagnet and enclosed within a coil form member, the axis of magnetization being perpendicular to the axis of the coil unit. Air-gap zones are located at both ends of the coil unit and a stationary yoke surrounds the two ends of the coil. Flat portions of the yoke which are parallel to the axis of magnetization each penetrate respectively into one air-gap zone so as to ensure that, at least in one stable position of the moving system, a flat portion of the yoke is in contact with one of the pole-pieces while the other flat portion is in contact with the other pole-piece. Better magnetic coupling between the coil, the air-gaps and the permanent magnet as well as higher operating efficiency are achieved.

10 Claims, 6 Drawing Figures

203
218a
226
224
223
212a
221a
214a
210a
204a
204b
214b
212b
219
217
227
222
214a
219a
211a
215a
225
207
205
210b
206
N
S
209
202
201
211b
214b
218

104
119
117
112a
118
114a
113a
110a
108
107
110c
110b
112b
106
N
S
114b
118
111a
109
112c
119
104a
101
102
104b

ELECTROMAGNET WITH A MOVING SYSTEM AND PERMANENT MAGNET, ESPECIALLY FOR CONTACTORS

This invention relates to an electromagnet with moving system and permanent magnet, especially for contactors.

Known electromagnets of this type comprise a moving system constituted by a permanent magnet and two flux-conducting pole-pieces attached respectively to each pole face of said magnet at right angles to the axis of magnetization of the magnet. These pole-pieces have arms which project from the pole faces and at least one pole-piece is provided with arms having ends which are bent back at right angles so as to define at least two air-gap zones with at least one arm of the other pole-piece. The two air-gap zones are adapted to cooperate with a yoke mounted on a coil which cooperates magnetically with the magnet. Said air-gap zones are located on each side of the axis of magnetization.

The introduction of permanent magnets in the magnetic circuits of electromagnets results in well-known advantages: higher efficiency, a longer range of travel, larger forces at the end of travel, and the possibility of bistable operation.

Some of these electromagnets are designed for rotational motion whereas others are designed for translational motion. The latter type is more suitable for the control of contactors.

Electromagnets of this known class are subject to a certain number of disadvantages which limit their efficiency. By reason of their arrangement, one of the main disadvantages lies in the fact that part of the flux through the coil is enclosed in air or by parasitic magnetic portions and does not serve to oppose the flux through the permanent magnet. Similarly, part of the permanent magnet flux is enclosed in air and does not serve to cooperate with the coil flux.

Finally, in the case of monostable operation, only part of the coil flux passes through the air-gaps.

Furthermore, from a mechanical standpoint, guiding of the moving system is unreliable, thus resulting in incomplete or wedge-contact closing operations. Even at the cost of close tolerances, it also proves difficult to ensure simultaneous closing of air-gaps.

The aim of this invention is to produce an electromagnet which overcomes the disadvantages mentioned above, this ensuring better magnetic coupling between the coil, the air-gaps and the permanent magnet and providing higher operating efficiency.

In accordance with the invention, the electromagnet described in the foregoing is distinguished by the fact that the moving system is located within the coil and that guiding means are provided for permitting translational motion of said system along the axis of the coil so as to constitute a sliding armature. The space inside the coil has a substantially rectangular cross-section occupied by the magnet and the pole-pieces and the axis of magnetization is perpendicular to the axis of the coil. The air-gap zones are located at both ends of the coil and the stationary yoke surrounds the two ends of the coil. Flat portions of the yoke which are parallel to the axis of magnetization each penetrate respectively into one air-gap zone so as to ensure that, at least in one stable position of the armature, a flat portion of the yoke is in contact with one of the pole-pieces whilst the other flat portion is in contact with the other pole-piece.

By virtue of these distinctive features, the entire flux through the coil is employed for opposing the flux through the permanent magnet. Conversely, the entire flux through the permanent magnet cooperates with the coil flux. Furthermore, localization of the armature permits simple and accurate guiding of this latter.

In a first embodiment of the invention which is intended to obtain two stable positions when the coil is not energized, each pole-piece forms two arms extending respectively on each side of the axis of magnetization. The ends of the arms of at least one pole-piece are bent back at right angles and the ends of one pole-piece are bent back beyond the arms of the other pole-piece with respect to the axis of magnetization.

The first pole-piece surrounds the second pole-piece and its bent-back ends are external to the yoke whilst the ends of the second pole-piece are internal to said yoke. In one position, the first pole-piece is in contact with a flat portion of the yoke whilst the other pole-piece is in contact with the other flat portion of said yoke. In the other position, the roles of the flat portions of the yoke are reversed with respect to the pole-pieces and two stable positions are thus obtained.

In a second embodiment of the invention which is intended to obtain a single stable position when the coil is not energized, a first pole-piece forms a single arm extending on a first side of the axis of magnetization whilst the other pole-piece is provided on said first side of the axis of magnetization with an arm whose end is bent back at right angles beyond said single arm of the first pole-piece with respect to the axis of magnetization and is provided on the second side of the axis of magnetization with two magnetically coupled arms whose ends are respectively bent back at right angles one beyond the other with respect to the axis of magnetization.

In a first position which is the only stable position, the magnetic circuit is closed by the single arm of the first pole-piece and by the other pole-piece. In the other position, the first pole-piece remains out of circuit and this position is not stable.

In an advantageous embodiment of the invention, the yoke consists of two U-shaped half-yokes which can be fitted one inside the other in an adjustable manner so as to permit adjustment of the spacing between the flat portions of the half-yokes.

While ensuring that very great simplicity of construction is maintained, steps can thus be taken to obtain simultaneous closing of the magnetic circuit on the two pole-pieces.

The moving system is preferably provided with a guide rod placed along the axis of the coil unit and slidably mounted in bearings fixed on stirrups which are attached respectively to each half-yoke.

By virtue of the accurate guidance thus provided, any danger of incomplete or wedge-contact closing of the magnetic circuit is practically removed.

In a particular embodiment of the invention, the moving system comprises two magnets having parallel axes, between which the guide rod passes and the magnets are locked in position by means of plates located at right angles to the guide rod and provided with tongues force-fitted in holes or slots of the pole-pieces.

In an alternative embodiment of the invention, a helical compression spring is placed on the guide rod between, on the one hand, the body of the moving system and, on the other hand, a washer applied by said spring against an annular shoulder of the guide rod. A stationary stop adapted to cooperate with said washer is intended to define the point of the travel of the moving system at which the spring begins its restoring action.

In this embodiment, the arms of one of the pole-pieces may be bent back away from the axis of the coil unit, in which case said unit is constituted by a winding formed on a frame consisting of two half-frames which are separable prior to winding.

Alternatively, one arm of one of the pole-pieces may be bent back towards the axis of the coil unit whilst the other arm is bent back in the opposite direction, in which case said coil unit comprises a one-piece frame.

In an alternative embodiment of the invention, the yoke is in the shape of a U so as to embrace the ends of the coil unit at least to a partial extent. The arms of the pole-piece which is located at the greatest distance from the yoke are bent back towards said yoke in order to embrace the branches of the U of the yoke at least to a partial extent whilst the other pole-piece is rectilinear.

Further distinctive features and advantages of the invention will become apparent from the following description, reference being made to the accompanying drawings which are given by way of example and not in any limiting sense, and in which.

Figure 2:
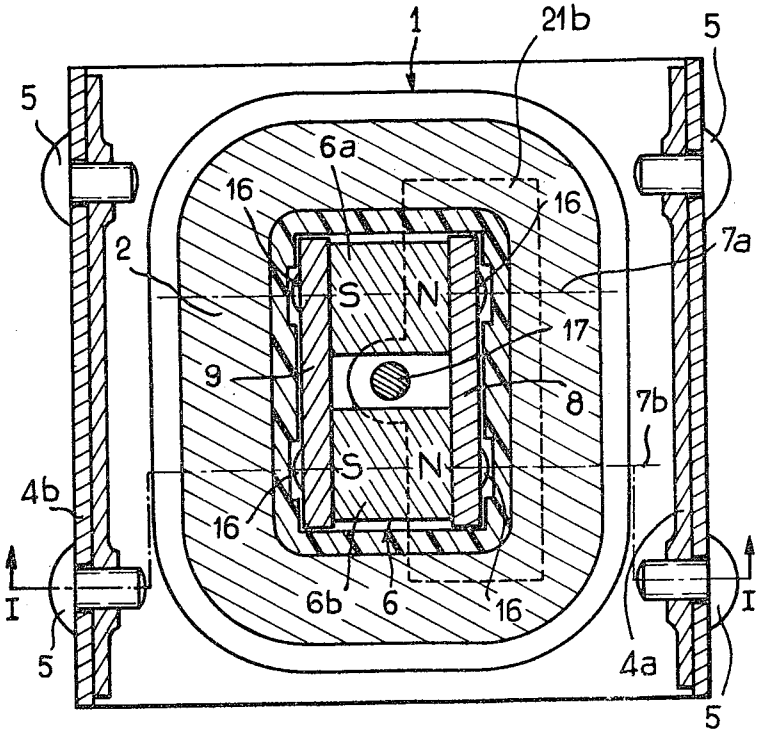
FIG. 2 is a sectional view taken along line II—II of FIG. 1.
Figure 1:
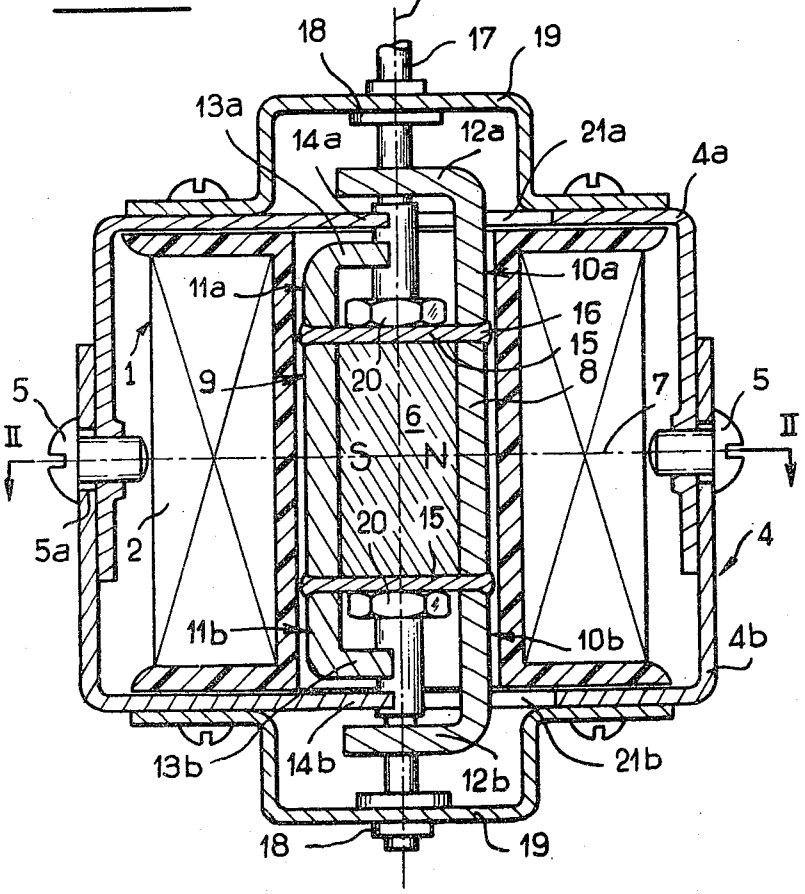
FIG. 1 is a vertical sectional view taken along line I—I of FIG. 2 and showing the electromagnet in accordance with the invention in one embodiment intended for bistable operation.

Referring to FIGS. 1 and 2, the electromagnet comprises a coil unit 1 in which the winding 2 is wound about the axis 3 of said unit. A stationary yoke 4 surrounds the coil unit and extends from one end of the space inside of the coil unit to the other end of said space. In practice, said yoke is constituted by two U-shaped half-yokes 4*a*, 4*b* assembled by interengagement in a direction parallel to the axis 3 of the coil unit, and held together by means of screws 5. Elongated slots 5*a* formed in one of the half-yokes permit the possibility of position-adjustment of said interengaged assembly. Provision is made within the space inside the coil for a sliding armature which is capable of translational displacement along the axis 3 of said coil unit. Said armature is constituted by a moving system comprising on the one hand a permanent magnet 6 so arranged that its axis of magnetization 7 is perpendicular to the axis 3 of the coil unit and, on the other hand, two flux-conducting pole-pieces 8 and 9 attached respectively to each pole face (N, S) of the permanent magnet 6 at right angles to its axis of magnetization 7. Each pole-piece 8, 9 has two arms 10*a*, 10*b* and 11*a*, 11*b* respectively which project from the pole faces (N, S) of the magnet 6.

In the example herein described, the permanent magnet 6 is composed of two magnets 6*a*, 6*b* having axes 7*a*, 7*b*, solely for constructional reasons. In the description which now follows, the assembly constituted by these two magnets will be generally designated by the reference numeral 6 for the sake of convenience.

The arms of the pole-pieces are bent back at right angles towards the axis 3 of the coil unit so as to form parallel end portions 12*a*, 12*b* and 13*a*, 13*b* respectively. In more precise terms, the end portions 12*a*, 12*b* of the pole-piece 8 are located respectively beyond the end portions 13*a*, 13*b* of the pole-piece 9 with respect to the axis of magnetization 7.

There are accordingly defined two air-gap zones located respectively between on the one hand the parallel end portions 12*a*, 13*a* and on the other hand the parallel end portions 12*b*, 13*b*. Said air-gap zones are located at both ends of the coil unit 1 and on each side of the axis of magnetization 7.

Furthermore, flat portions 14*a*, 14*b* of the yokes 4*a*, 4*b* which are parallel to the axis of magnetization 7 each penetrate respectively into one air-gap zone. The pole-pieces 8, 9 are attached to the magnet 6 by means of plates 15 which are perpendicular to the axis 3 of the coil unit and provided with tongues 16 force-fitted in slots of the pole-pieces.

A guide rod 17 is rigidly fixed to the moving system and guided along the axis 3 of the coil unit by means of bearings 18 fixed on stirrups 19 which are in turn attached to each half-yoke 4*a*, 4*b* by means of screws.

The guide rod 17 passes between the magnets 6*a*, 6*b* (as shown in FIG. 2), passes right through the moving system and is attached to this latter by means of nuts 20 (as shown in FIG. 1).

The space inside of the coil unit 1 has a substantially rectangular cross-section (as shown in FIG. 2) and is designed in practice to contain the magnets and pole-pieces.

The operation of said electromagnet is as follows:

When the moving system (shown in an intermediate position in FIG. 1) takes up its bottom end position, the flux emerging from the permanent magnet 6 through the pole face N passes into the pole-piece 8, the arm 10*a*, the bent-back end portion 12*a* and the flat portion 14*a* of the yoke 4*a*. The flux then passes through the U-shaped arms of the half-yokes to the flat portion 14*b* of the yoke 4*b*, to the bent-back end portion 13*b*, to the pole-piece 9 and to the pole face S of the permanent magnet 6.

The closed air-gaps 12*a*, 14*a* and 13*b*, 14*b* generate forces in the same direction which maintain the moving system in its bottom end position.

If the coil is energized in a direction which produces a flux opposite to the previous direction, the previous forces are reduced to zero. Attractive forces then appear between the air-gaps 13*a*, 14*a* and 12*b*, 14*b*, thus bringing the moving system to its top end position.

Bistable operation is therefore achieved without having recourse to any restoring force and with higher efficiency.

As will be readily understood, in order to prevent shunting of the air-gap 12*a*, 14*a*, an opening 21*a* of sufficient size must be formed in the yoke 4*a* around the arm 10*a*. A similar opening 21*b* must be provided in the case of the arm 10*b*. These openings also facilitate assembly of the half-yokes on the coil unit equipped with its armature.

Furthermore, it is necessary to obtain simultaneous and complete closing of the air-gaps in each end position since the performances of the electromagnet would otherwise be considerably reduced.

Since all the air-gap surfaces are parallel to each other and since the translational displacement of the moving system is well guided, closing of the air-gaps in a wedge action is accordingly prevented.

At the time of assembly of the moving system, it is an easy matter to obtain identical distances between the bent-back end portions 12*a*, 13*a* and 12*b*, 13*b* respectively.

Accordingly, in order to obtain complete closing of the air-gaps, it is only necessary to adjust the distance between the flat portions 14*a* and 14*b* of the yokes, this operation being performed for example by adjusting the extent of interengagement of the half-yokes. This can be achieved simply by locking the screws 5 in position only when the electromagnet is energized.

Figure 3:
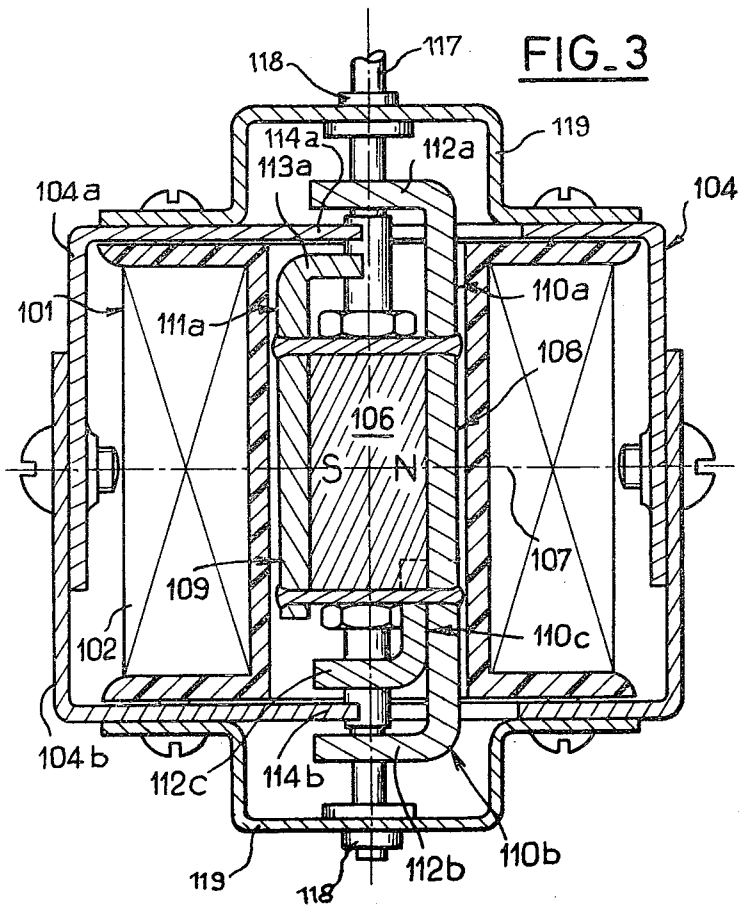
FIG. 3 is a view which is similar to FIG. 1 but in an embodiment intended for monostable operation.

Referring to FIG. 3, there will now be described an alternative embodiment of the invention which provides for the possibility of monostable operation.

In this figure, elements which are identical or similar to those of the embodiment previously described are designated by the same reference numeral increased by 100. Except in isolated instances, only new or different elements will be described.

In this case the pole-piece 109 has only one arm 111*a* which is bent-back at 113*a*. On the other hand, there has been added another arm 110*c* which is parallel to the arm 110*b* of the pole-piece 8 and coupled magnetically to said arm 110*b*. One end 112*c* of said arm 110*c* is bent back at right angles so as to be located in the plane which had previously been occupied by the end portion 13*b* of the arm 11*b* in the embodiment of FIG. 1. The result of this arrangement is that, in the top position of the moving system, nothing has been changed with respect to the previous case. On the contrary, in the bottom position, the magnetic circuit cannot be closed by the pole-piece 109 which does not have a bottom arm for cooperating with the flat portion 114*b*. In consequence, the flat portions 114*a* and 114*b* of the half-yokes 104*a* and 104*b* are directly and magnetically connected together by means of the pole-piece 108 and its arms and bent-back ends without passing through the permanent magnet 106. As a result of the reaction of a controlled mechanical load or under the action of a restoring spring, the moving system will therefore return to its top position after the coil has been de-energized. The operation of the electromagnet has therefore become monostable.

Another embodiment of the invention will now be described with reference to FIG. 4. In this embodiment, elements which are either identical or similar to those of the previous embodiments are designated by the same reference numeral preceded by the digit 2 of the hundreds. The following description will relate essentially to the differences.

The pole-piece 209 is rectilinear and does not have bent-back end portions, the surface of the air-gaps being provided directly by the end face (or transverse section) of each arm 211*a* and 211*b*. A reduction in area of the air-gap results in a steeper slope of the curve of force as a function of the distance of travel, which may be acceptable or desirable in some cases.

In addition, the bent-back end portions 212*a* and 212*b* of the pole-piece 208 are bent outwards with respect to the axis 203 of the coil unit. In consequence, the forces are generated further away from the axis 203 but the corresponding torque can be resisted by the guide rod 217. Furthermore, these outwardly directed end portions make it necessary for assembly purposes to design the frame of the coil unit 201 in the form of two separable portions.

The air-gap 12*a*–14*a* of FIG. 1 is now replaced by an air-gap 212*a*–214*a*, the flat portion 214*a* of the half-yoke 204*a* being located at the same level as the flat portion 14*a* of FIG. 1.

The air-gap zone concept therefore remains valid if these zones are defined with reference to the axis of magnetization 7 or 207.

This arrangement limits the leakage flux between the pole-pieces 208 and 209 and facilitates the positioning of a restoring spring.

A helical spring 222 is placed on one of the end portions of the guide rod 217. Said spring is compressed between the plate 215*a* and a washer 223, said washer being in turn applied against an elastic ring 224 which is inserted in a groove of the guide rod 217. The nut 20 of FIG. 1 may be replaced by another elastic ring 225. Furthermore, the bearing 218*a* may be screwed more or less deeply in the stirrup 219*a* and locked in position by means of a nut 226. An annular shoulder 227 of the bearing 218*a* serves as a stationary stop for the washer 223 during any movement of this latter towards the corresponding end-of-travel position. As will therefore be apparent, it is possible to adjust the moment of the travel at which the spring 222 exerts its restoring force on the moving system.

Apart from these differences, the operation is substantially the same as in the embodiment of FIG. 1.

Figure 5:
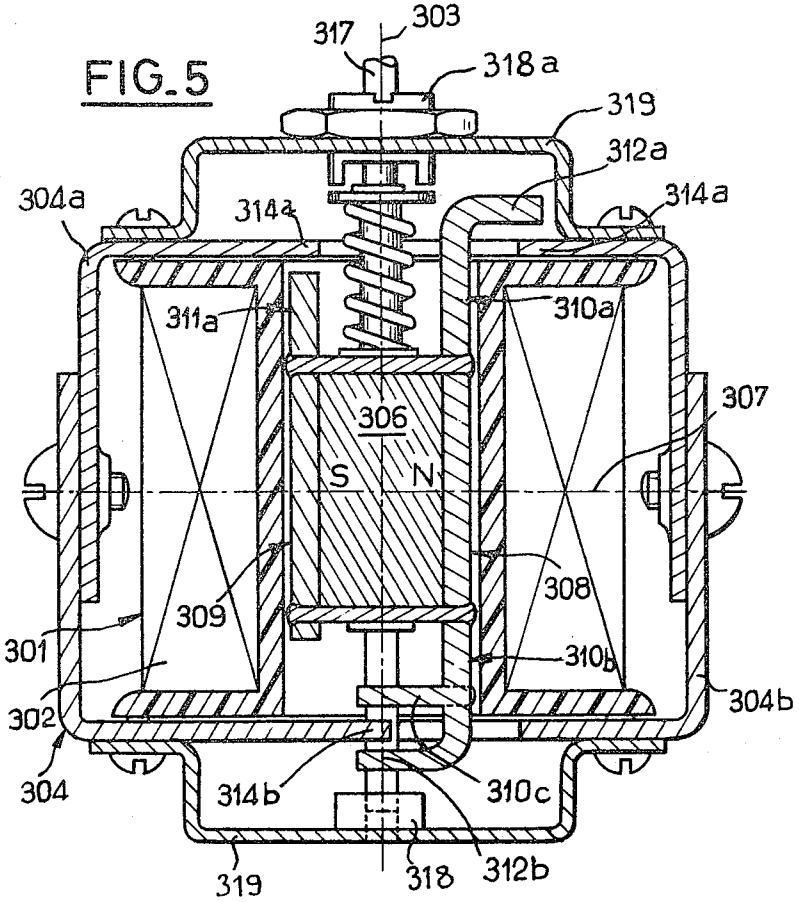

The last embodiment herein described can be carried into effect in a monostable version (shown in FIG. 5). In this version, the pole-piece 309 is provided with only one arm 311*a* and the pole-piece 308 has a third arm 310*c* which is coupled magnetically to the arm 310*b*. These arrangements are similar to those shown in FIG. 3 and provide monostable operation in accordance with the explanations given with reference to this figure in regard to the operation of the electromagnet.

The bent-back end portion 312*a* of the pole-piece 308 is again directed outwards but the bent-back portion 312*b* is directed inwards as well as the arm 310*c*. This arrangement facilitates assembly and makes it possible to employ a one-piece coil frame.

Figure 6:
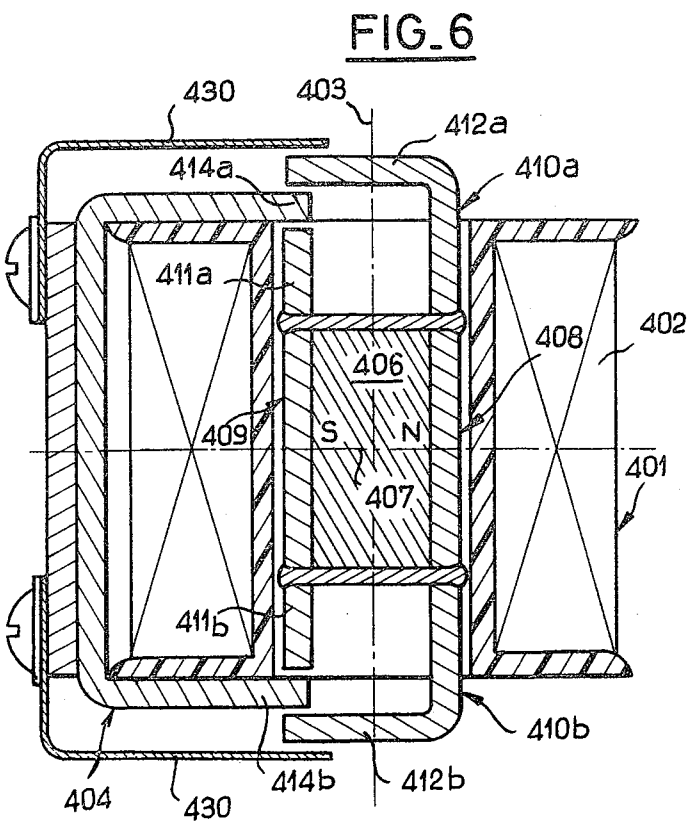
FIG. 6 is a similar view in an alternative embodiment involving the use of a U-shaped yoke.

Referring to FIG. 6, there will now be described a simplified alternative embodiment of the invention. In this alternative form, the yoke 404 consists of a single U-shaped member which embraces the ends of the coil unit 401 at least to a partial extent, the ends of the branches of the U being intended to constitute flat portions 414*a*, 414*b*.

Figure 4:
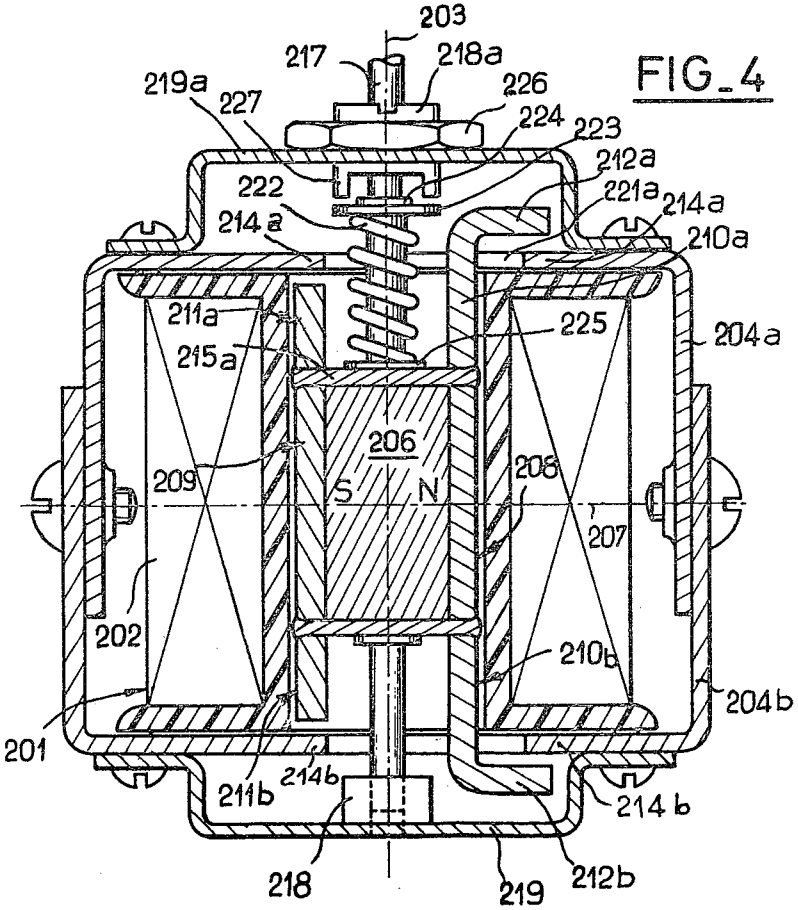
FIGS. 4 and 5 are views which are similar to FIG. 1 in an alternative arrangement of the pole-pieces in which a restoring spring is incorporated.

The moving system is similar to the system shown in FIG. 3 except for the fact that, although the pole-piece 408 is again provided with arms 410*a*, 410*b* which are bent back at 412*a*, 412*b* so as to embrace the branches 414*a*, 414*b* of the U-shaped yoke, the pole-piece 409 is rectilinear as in the case of FIG. 4 and works only by means of the end faces of the arms 411*a*, 411*b*.

The clearance between the moving system and the coil is intended to be of very small value, with the result that the coil frame serves to guide said system.

Resilient strips 430 of non-magnetic material are fixed on the yoke in order to perform a restoring function.

In this embodiment, the electromagnet is bistable but could be adapted for monostable operation by means of the modifications explained earlier.

The improvements introduced by the invention in the field of magnetic coupling have led to the achievement of remarkably enhanced efficiency. Thus, by adopting an iron-core cross-section of 25 $mm^2$ and a magnet thickness of 2 mm, it is possible to obtain a displacement of 4 mm with end-of-travel forces of the order of 10 Newton, the power required being of the order of only one watt.

The advantages thus gained are the same as those offered by movable-core magnetic circuits without permanent magnets, especially in regard to magnetic coupling between the coil and the air-gaps and also in regard to guiding of the moving system.

As will readily be apparent, the invention is not limited to the examples hereinabove described but extends to any technological variant which is within the capacity of anyone versed in the art.

What is claimed is:

1. An electromagnet especially for contactors and comprising a moving system constituted by at least one permanent magnet and two flux-conducting pole-pieces attached respectively to each pole face of said magnet at right angles to the axis of magnetization of the magnet, said pole-pieces being provided with arms which project from the pole faces, at least one of the pole-pieces being provided with arms whose ends are bent back at right angles so as to define two air-gap zones with at least one arm of the other pole-piece, said air-gap zones being adapted to cooperate with a yoke mounted on a coil unit which cooperates magnetically with the magnet, said air-gap zones being located on each side of the magnetization axis, wherein said moving system is placed within the interior of the coil unit, guiding means being provided so as to permit translational displacement of said system along the axis of the coil unit in such a manner as to constitute a sliding armature, wherein the space inside the coil unit has a substantially rectangular cross-section occupied by the magnet and the pole-pieces, the axis of magnetization being perpendicular to the axis of the coil unit, wherein the air-gap zones are located at the two ends of the coil unit, and wherein the stationary yoke surrounds the two ends of the coil unit, flat portions of the yoke which are parallel to the axis of magnetization being each adapted to penetrate respectively into one air-gap zone so that, in at least one stable position of the armature, one flat portion of the yoke is in contact with one of the pole-pieces whilst the other flat portion is in contact with the other pole-piece.

2. An electromagnet according to claim 1 and having two stable positions when the coil is not energized, wherein each pole-piece forms two arms extending respectively on each side of the axis of magnetization, wherein the end portions of the arms of at least one pole-piece are bent back at right angles and wherein said end portions are bent back beyond the arms of the other pole-piece with respect to the axis of magnetization.

3. An electromagnet according to claim 1 and having a single stable position when the coil is not energized, wherein a first pole-piece forms a single arm extending on a first side of the axis of magnetization whilst the other pole-piece is provided on the first side of the axis of magnetization with an arm whose end portion is bent back at right angles beyond said single arm of the first pole-piece with respect to the axis of magnetization and is provided on the second side of the axis of magnetization with two magnetically coupled arms whose end portions are respectively bent back at right angles and one beyond the other with respect to the axis of magnetization.

4. An electromagnetic according to claim 2 or claim 3, wherein the yoke is constituted by two U-shaped half-yokes which can be adjustably interengaged so as to permit adjustment of the spacing between the flat portions of said half-yokes.

5. An electromagnet according to claim 4, wherein the moving system is provided with a guide rod placed along the axis of the coil unit and slidably mounted in bearings fixed on stirrups which are fixed respectively on each half-yoke.

6. An electromagnet according to claim 5, wherein the moving system comprises two magnets having parallel axes between which the guide rod passes and wherein the magnets are locked in position by means of plates located at right angles to the guide rod and provided with tongues force-fitted in holes or slots of the pole-pieces.

7. An electromagnet according to claim 5 or claim 6, wherein a helical compression spring is placed on the guide rod between on the one hand the body of the moving system and on the other hand a washer applied by said spring against an annular shoulder of the guide rod, a stationary stop being adapted to cooperate with said washer and to define the point of the travel of the moving system at which the spring begins its restoring action.

8. An electromagnet according to claim 7, wherein the arms of one of the pole-pieces are bent back away from the axis of the coil unit, said unit being constituted by a winding formed on a frame consisting of two half-frames which are separable prior to winding.

9. An electromagnet according to claim 7, wherein one arm of one of the pole-pieces is bent back towards the axis of the coil unit whilst the other arm is bent back in the opposite direction, said coil unit comprising a one-piece frame.

10. An electromagnet according to claim 2 or claim 3, wherein the yoke has the shape of a U so as to embrace the ends of the coil unit at least to a partial extent, the arms of the pole-piece which is located at the greatest distance from the yoke being bent back towards said yoke in order to embrace the branches of the U of the yoke at least to a partial extent whilst the other pole-piece is rectilinear.

* * * * *